US005118905A

United States Patent [19]

Harada

[11] Patent Number: 5,118,905

[45] Date of Patent: Jun. 2, 1992

[54] COAXIAL CABLE

[75] Inventor: Jiro Harada, Tokyo, Japan

[73] Assignee: Harada Kogyo Kabushiki Kaisha, Tokyo, Japan

[21] Appl. No.: 273,425

[22] Filed: Nov. 18, 1988

[51] Int. Cl.[5] ..... H01B 7/34

[52] U.S. Cl. ..... 174/109; 156/47; 156/51

[58] Field of Search ..... 174/36, 109; 156/47, 156/51; 87/8, 9

[56] References Cited

U.S. PATENT DOCUMENTS

| | | | |
|---|---|---|---|
| 2,028,793 | 1/1936 | Mascuch | 174/109 X |
| 2,698,353 | 12/1954 | Carr et al. | 156/51 |
| 2,863,032 | 12/1958 | Morris | 174/109 |
| 2,924,141 | 2/1960 | Kinniburgh | 87/9 |
| 3,240,867 | 3/1966 | Maddox | 174/109 |
| 4,376,920 | 3/1983 | Smith | 174/36 X |
| 4,552,989 | 11/1985 | Sass | 174/109 X |
| 4,694,122 | 9/1987 | Visser | 174/109 X |
| 4,719,319 | 1/1988 | Tighe, Jr. | 174/109 X |
| 4,719,320 | 1/1988 | Strait, Jr. | 174/109 X |
| 4,868,565 | 9/1989 | Mettes et al. | 174/36 X |

FOREIGN PATENT DOCUMENTS

| | | | |
|---|---|---|---|
| 873673 | 7/1942 | France | 174/109 |

*Primary Examiner*—Morris H. Nimmo
*Attorney, Agent, or Firm*—Koda and Androlia

[57] ABSTRACT

A coaxial cable is disclosed that employs a plain stitch wire tube formed by braiding a plurality of flattened individual solid metal conductors. The plain stitch wire tube obtained by braiding the flattened conducting wires acts as an external conductor. The coaxial cable may be used, for example, as a feeder cable for an automobile antenna. The coaxial cable thus obtained provides improved shielding against inductive interference and can be manufactured at a lower cost compared with conventional cables.

7 Claims, 4 Drawing Sheets

COAXIAL CABLE

BACKGROUND OF THE INVENTION

1. Field of Invention

This invention relates to a coaxial cable useful as the feeder cable of an automobile antenna.

2. Description of Related Art

FIG. 1 is a perspective view showing a conventional coaxial cable having a shielding braided wire tube as an external conductor to reduce inductive interference and the resulting external noise on the receiving radio waves. A central conductor 10 held in a cylindrical insulator 12 extends along the length of the cable. The conductor 10 is made of steel wire or another substance having superior electrical conductivity. The cylindrical insulator 12 is made of resin such as polyethylene. A braided wire tube 14 for blocking external noise extends along the outer circumference of the insulator 12 as the external conductor. A cylindrical insulating cover 16 completes the cable.

As shown in FIG. 2, in the typical coaxial cable, the braided wire tube 14 is formed using four thin conducting wires a, b, c, and d having a diameter of 0.14 mm each and arrayed in parallel to each other to form a set of element wires (a strand). By braiding, for example, sixteen sets of such strands 20, 21, 22, 23, 24, 25, . . . so as to cover the outer circumference of the insulator 12. The braided wire tube 14 is coaxial with the central conductor 10 and the insulator 12 is interposed between the tube 14 and conductor 10. A part of the tube 14 is grounded to shield against inductive interference. An example of a cable made using a plurality of fine braided wires as a part of a shield is shown in U.S. Pat. No. 2,028,793. U.S. Pat. No. 4,552,989 also appears to describe a shielded coaxial cable made using a plurality of fine wires.

Conventional coaxial cables with the described structure have certain problems. For instance, the conducting wires a, b, c, and d have a diameter of about 0.14 mm each. Because the wire diameter is very small, the conducting wires are frequently broken or cut during the braiding process, thereby reducing product yield. Also, the four conducting wires a through d of the braided wire tube 14 are wound on bobbins and then braided. The wire break detection sensor cannot detect broken wires unless all four conducting wires are cut and so broken wire defects are not accurately detected. As a result, defective products having one or two broken wires in the braided wire tube 14 are mixed with non-defective products, thus causing a high rate of non-uniformity in product quality.

Another problem occurs during the processing of the end of the coaxial cable. FIG. 3 shows an example of coaxial cable end processing. The portion 14A to be processed at the end of the braided wire tube 14 is shown peeled and turned back toward the outer cover 23. The portion 14A is to be soldered to a grounded conductor. When the portion 14A is peeled back, one or more of the thin conducting wires a, b, c, and d forming the braided wire tube 14 often fall into the space between the braided wire tube 14 and the insulator 12, as shown by a filament 14B in FIG. 3. The thin filament 14B is often overlooked and frequently causes a short-circuit with the central conductor 10 during use. To prevent such a short-circuit, double or triple inspections must be made for the presence of such filaments 14B, thereby reducing productivity.

According to French Pat. No. 873,673 a flat conductor is wound around the cable to form the tube. According to U.S. Pat. No. 3,240,867 a tube is shielded with a braided metal cover for inclusion in an extensible cable. Braiding flat material around a wire is also shown in U.S. Pat. No. 2,863,032 for use in an insulated heater wire.

SUMMARY OF THE INVENTION

According to the present invention, a coaxial cable is provided that alleviates these and other problems of prior cables. One object of the present invention is to provide a high quality coaxial cable with fewer wire breakage defects caused by the braiding process for the braided wire tube of the coaxial cable. Another object of the present invention is to reduce the manufacturing cost of a coaxial cable by inhibiting the formation of stray filaments when processing the end portion of the braided wire tube.

The present invention attains the foregoing objects without the drawbacks of the previous end processing methods. According to the present invention, a plain stitch wire tube made by braiding a plurality of zonal conducting wires each having an flattened cross-section are used as the external conductor.

By using a flattened conducting wire, the following effect is obtained. When the cross-sectional area and the form of a flattened conducting wire are equivalent to that of a set of conducting wires (a strand) in a conventional braided wire tube, the tensile strength is improved in comparison with the conventional single conducting wires. Accordingly, the wire breakage rate in the braiding process is substantially lowered. Furthermore, the frequency of defects caused by conducting wires falling out of the braid during coaxial cable end processing is sharply reduced. Thus, the time required to detect the defect is cut, thereby reducing the manufacturing cost. In addition, the plain stitch wire tube obtained through interknitting is equal in thickness to a conventional counterpart and the gaps among the conducting wires are less. As a result, shielding against inductive interference is further improved in comparison with a conventional coaxial cable.

BRIEF DESCRIPTION OF THE DRAWINGS

The coaxial cable of the present invention may be better understood by reference to the attached Drawings in conjunction with the following Detailed Description, wherein.

Figure 6A:
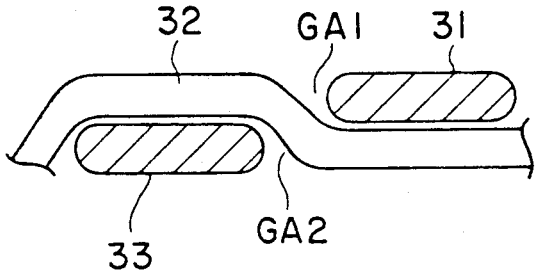
Figure 6B:
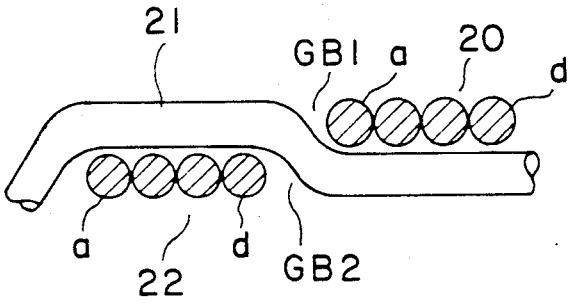
Figure 6C:
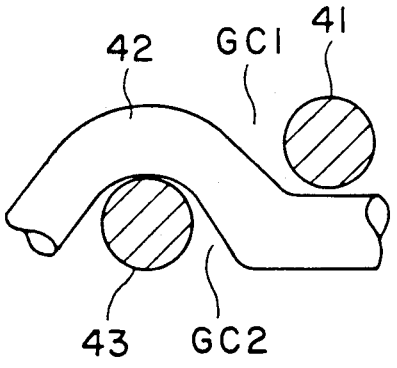

FIG. **6*a*** is a partial sectional view of the plain stitch wire tube according to the present invention;

FIG. **6*b*** is a partial sectional view of a conventional braided wire tube, shown for comparative purposes; and FIG. 6*c* is a partial sectional view of a braided wire tube having a cylindrical conducting wire with a cross-sectional area equal to that of the conducting wire of the braided wire tube shown shown in FIG. 6*a*.

DETAILED DESCRIPTION OF THE INVENTION

Figure 1:
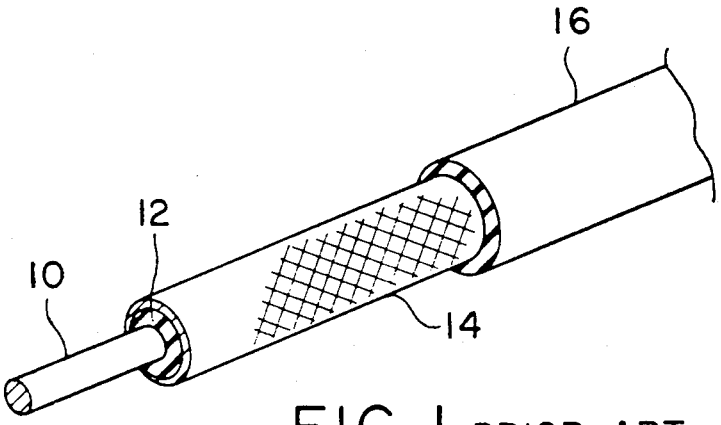
FIG. 1 PRIOR ART
FIG. 1 is a perspective view schematically showing the structure of a coaxial cable.
Figure 2:
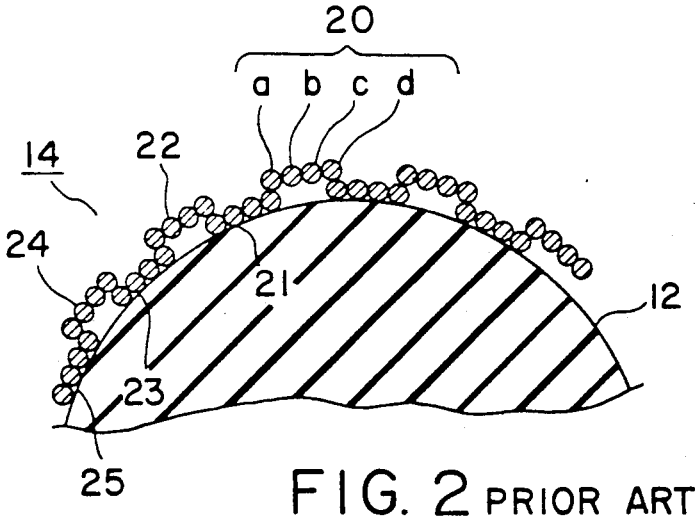
FIG. 2 PRIOR ART
FIG. 2 is a sectional view showing the the details of a conventional plain stitch wire tube.
Figure 3:
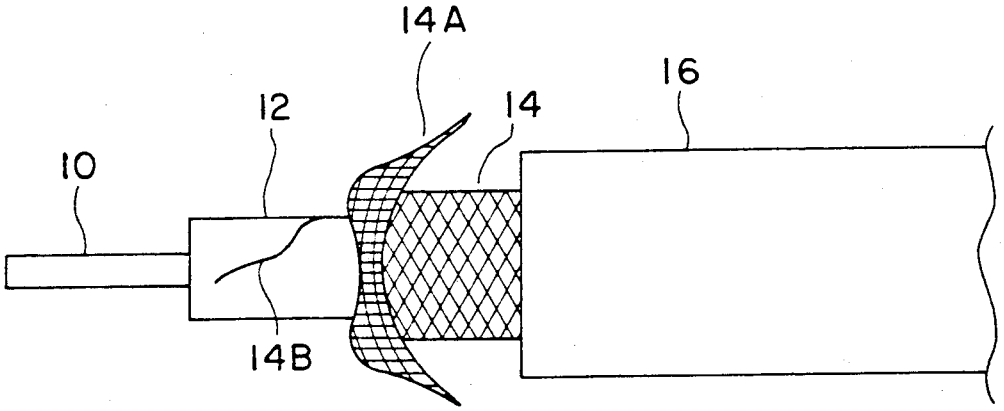
FIG. 3 PRIOR ART
FIG. 3 is a side view showing the end processing for a coaxial cable.
Figure 4:
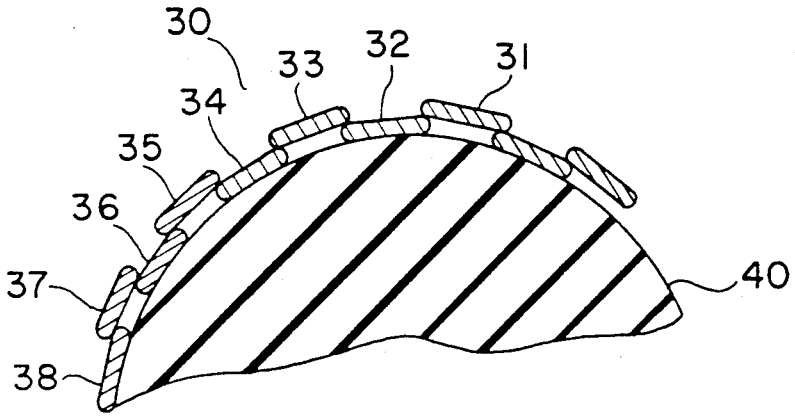
FIG. 4 is a sectional view showing the structure of a plain stitch wire tube according to the present invention.

Referring now to FIG. 4, a sectional view of an embodiment of the present invention corresponding to the example of a conventional braided wire tube of FIG. 2 is shown. As shown in FIG. 4, a plain stitch wire tube 30 is formed by braiding a plurality of zonal conducting wires 31, 32, . . . and 38 each having a flattened cross-sectional shape. The tube 30 is disposed so as to cover the outer circumferential surface of the insulator 40.

Figure 5:
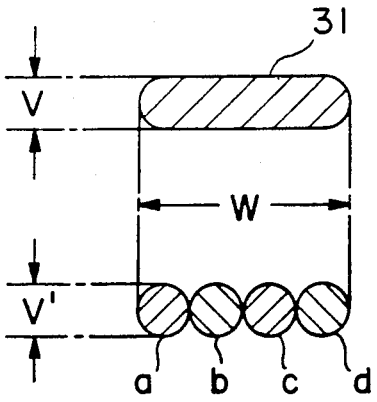
FIG. 5 is a cross-sectional view comparing the conducting wire according to the present invention with prior conducting wires.

FIG. 5 shows a cross-sectional view of one zonal conducting wire 31 of the plain stitch wire tube 30 in detail. The zonal conducting wire 31 is made by flattening a conducting wire having a diameter of about 0.32 mm. The wire 31 is formed into a flattened shape having cross-sectional dimensions equivalent to those of the conventional four thin wires 20*a* through 20*d* arrayed in parallel to each other, that is, about 0.13 mm in thickness V and about 0.58 mm in width W. Accordingly, the tensile strength of the zonal conducting wire 31 is about four or more times that of each of the conventional single conducting wires a, b, c and d.

FIG. 6 shows sectional views of the the braided wire tubes. FIG. 6*a* is a partial sectional view of the plain stitch wire tube 30 according to the present invention. FIG. 6*b* is a partial sectional view of the conventional braided wire tube shown for comparison. FIG. 6*c* is a partial sectional view of a braided wire tube wherein the cylindrical conducting wires have a cross-sectional area equal to that of the zonal conducting wire 31 of the plain stitch wire tube 30.

As shown in FIG. 6*a*, gaps GA1 and GA2 are formed between the conducting wires 32 and 33. Likewise, as shown in FIG. 6*b*, gaps GB1 and GB2 are formed in the conventional wire tube. The gaps GA1 and GA2 have almost the same size as the gaps GB1 and GB2. However, the gaps GA1 and GA2 are very small compared to the gaps GC1 and GC2 formed between the conducting wires 41 and 42 and between the conducting wires 42 and 43 as shown in FIG. 6*c*. As the diameter of the cylindrical wire shown in FIG. 6*c* increases, the gaps GC1, GC2 become significantly larger than the gaps GA1 and GA2 in the embodiment of the present invention. Therefore, the shielding effect is seriously lowered, and also the thickness dimension is increased.

Also, although small gaps exist between the respective conducting wires a through d of the braided wire strands 20, 21, . . . of the conventional braided wire tube as shown in FIG. 6*b*, according to the present invention the use of flattened conducting wires 31, 32, . . . to form the plain stitch wire tube 30 eliminates these additional gaps. Consequently, the plain stitch wire tube 30 according to the present invention is better shielded against inductive interference.

As mentioned, the plurality of flattened zonal conducting wires 31, 32, . . . are interknitted. When the cross-sectional area and the form of each of the zonal conducting wires 31, 32 . . . correspond to those of one braided strand of the conventional braided wire tube 14, the tensile strength is improved in comparison with that of the conventional single conducting wires. As a result, the wire breakage rate during the braiding process is substantially lowered. Furthermore, in the end processing of the coaxial cable, the frequency of defects due to filaments falling out of the braid is markedly reduced. Thus, the time required for detecting defects is shortened and the inspection process is simplified thereby reducing manufacturing costs.

The thickness of the braided plain stitch wire tube 30 is equal to that of the conventional counterpart and the gaps among the conducting wires decrease. As a result, the cable is better shielded against inductive interference in comparison with conventional cables. The rigidity of the plain stitch wire tube 30 is increased. Although pliability is somewhat lowered, it was confirmed experimentally that no problem is caused when the cable of the present invention is used as the feeder cable of the automobile antenna.

The present invention is not limited to the embodiment described above. For example, in the embodiment shown in FIG. 5, the zonal conducting wire 31 had a cross-sectional area with V equal to about 0.13 mm and W equal to about 0.58 mm. However, the dimensions are not limited to those shown above, and they may be selected appropriately according to the purpose of use. Obviously, many other modifications and variations may be made within the scope of the present inventive concepts which are delineated by the following claims.

In the present invention, because the plain stitch wire tube formed by braiding the plurality of flattened zonal conducting wires is used as the external conductor, defects in the wire tube of the coaxial cable are reduced, and the formation of the filaments during the processing of the end of the braiding strand can be restricted, thereby cutting down the manufacturing cost and making it possible to provide high quality products. These and other advantages will all be apparent to those of skill in the art. Of course, the above disclosure is merely representative and is not meant to limit the invention in any way.

I claim:

1. A coaxial cable for use as a vehicle antenna feeder cable consisting substantially of:

an electrically connective wire forming a central conductor;

an insulator formed from a dielectric material covering the central conductor;

a plurality of individual solid metal flattened conductors braided to form a plain stitch braided wire tube around the circumference of the insulator for blocking external inductive interference; a cylindrical insulating cover over the wire tube and wherein each individual solid metal flattened conductor comprises a plurality of flattened cylindrical solid metal conducting wires having a predetermined diameter.

2. The cable of claim 1 wherein the electrically conductive wire forming the central conductor comprises steel.

3. The cable of claim 1 wherein the insulator comprises a resin.

4. The cable of claim 1 wherein the insulator comprises polyethylene.

5. The cable of claim 1 wherein the cylindrical insulating cover over the tube comprises a dielectric resin.

6. The cable of claim 1 wherein the flattened individual solid metal conductors have a width of approximately 0.58 mm and a thickness of approximately 0.13 mm.

7. A method of manufacturing a coaxial cable comprising:

flattening each a plurality of cylindrical solid metal conducting wires each having a predetermined diameter to form a plurality of individual solid metal conductors having a flattened cross-sectional shape of predetermined dimensions, said flattened individual solid metal conductors having a width of substantially 0.58 mm and a thickness of substantially 0.13 mm.

covering an electrically conductive wire forming a central conductor with a dielectric insulating layer;

interbraiding the plurality of flattened individual solid metal conductors over the insulating layer to form a plain stitch braided wire tube around the circumference of the insulator for blocking external inductive interference and for acting as an external conductor for the coaxial cable; and applying a cylindrical insulating cover made from a dielectric resin over the tube.

* * * * *